US011260942B2

(12) United States Patent
Heeter

(10) Patent No.: US 11,260,942 B2
(45) Date of Patent: Mar. 1, 2022

(54) MODULAR INTERLOCKING FLOATATION ASSEMBLY

(71) Applicant: Lonny Heeter, Sheffield, PA (US)

(72) Inventor: Lonny Heeter, Sheffield, PA (US)

( * ) Notice: Subject to any disclaimer, the term of this patent is extended or adjusted under 35 U.S.C. 154(b) by 0 days.

(21) Appl. No.: 16/575,047

(22) Filed: Sep. 18, 2019

(65) Prior Publication Data

US 2021/0078680 A1 Mar. 18, 2021

(51) Int. Cl.

| | |
|---|---|
| ***B63B 35/58*** | (2006.01) |
| ***B63B 35/44*** | (2006.01) |
| ***B63B 35/38*** | (2006.01) |
| ***E02B 3/06*** | (2006.01) |

(52) U.S. Cl.

CPC ..... *B63B 35/58* (2013.01); *B63B 35/38* (2013.01); *B63B 35/44* (2013.01); *E02B 3/064* (2013.01)

(58) Field of Classification Search

CPC ..... B63B 35/00; B63B 35/34; B63B 35/38; B63B 35/44; B63B 3/00; B63B 3/08; B63B 7/00; B63B 7/04; B63B 35/58; E02B 3/00; E02B 3/064

USPC ..... 114/263, 266, 267, 125; 441/35

See application file for complete search history.

(56) References Cited

U.S. PATENT DOCUMENTS

| | | | | |
|---|---|---|---|---|
| 3,057,315 | A | 10/1962 | Robishaw | |
| 3,152,568 | A * | 10/1964 | Mayer | E02B 3/064 114/266 |
| 4,988,317 | A | 1/1991 | Rubinsak | |
| 5,129,347 | A | 7/1992 | Hill | |
| 5,803,007 | A | 9/1998 | Stevens | |
| 6,145,463 | A * | 11/2000 | Zeilinger | B63B 3/06 114/267 |
| 6,179,525 | B1 | 1/2001 | Gruhn | |
| 2004/0028478 | A1 * | 2/2004 | Lekhtman | B63B 3/08 114/263 |
| 2006/0116039 | A1 | 6/2006 | Pole | |

* cited by examiner

*Primary Examiner* — Lars A Olson

(57) ABSTRACT

A modular interlocking flotation assembly for selective creation of a raft includes a plurality of shells. Each of a plurality of couplers is coupled to a respective shell so that the shells of the plurality of shells are selectively interconnectable in a substantially planar configuration. The plurality of shells thus interconnected is configured to function selectively a raft and a portable dock.

16 Claims, 7 Drawing Sheets

MODULAR INTERLOCKING FLOATATION ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to flotation assemblies and more particularly pertain to a new flotation assembly for selective creation of a raft.

BRIEF SUMMARY OF THE INVENTION

An embodiment of the disclosure meets the needs presented above by generally comprising a plurality of shells. Each of a plurality of couplers is coupled to a respective shell so that the shells of the plurality of shells are selectively interconnectable in a substantially planar configuration. The plurality of shells thus interconnected is configured to function selectively a raft and a portable dock.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
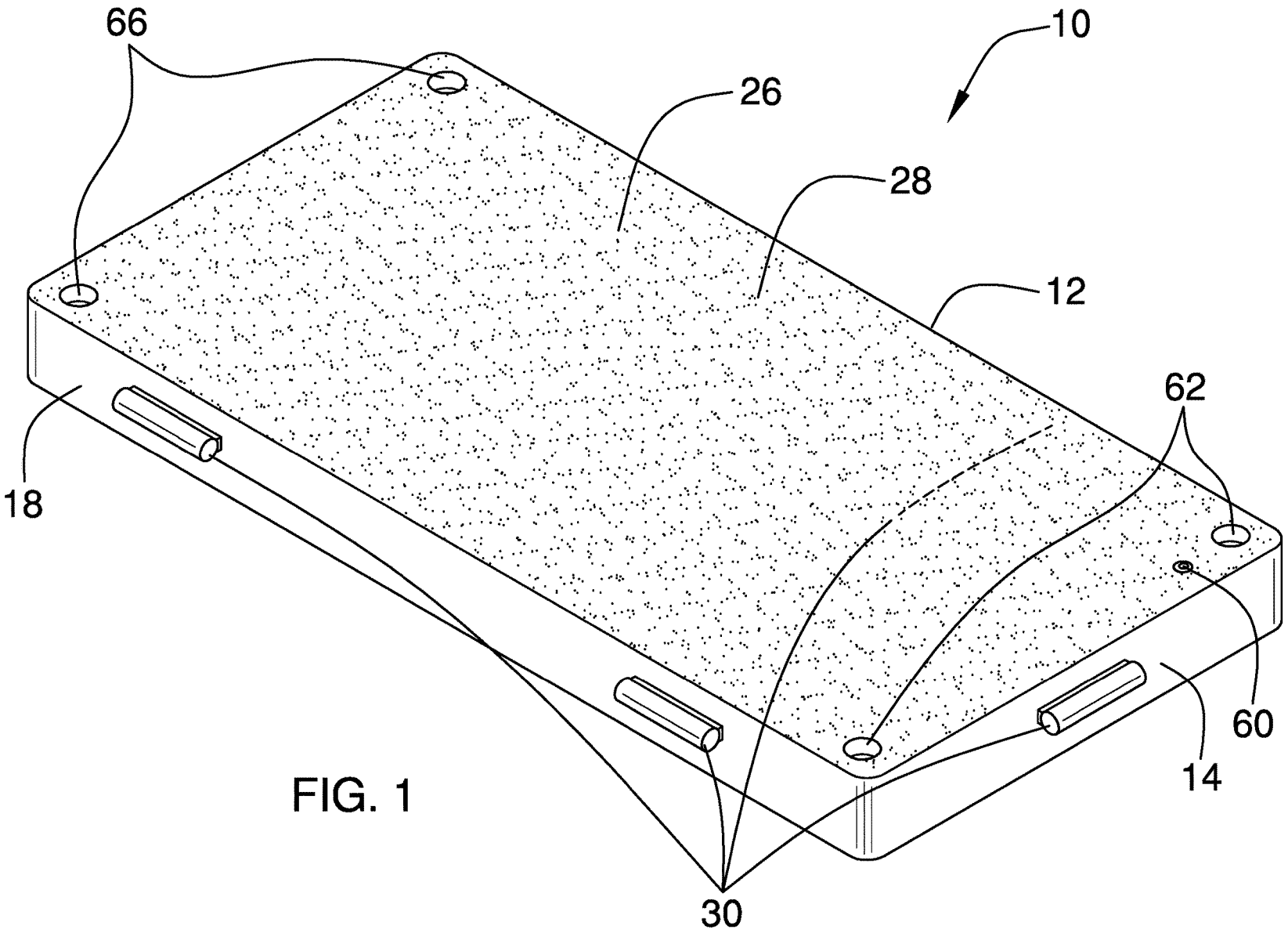
FIG. 1 is a top isometric perspective view of a modular interlocking flotation assembly according to an embodiment of the disclosure.

With reference now to the drawings, and in particular to FIGS. 1 through 8 thereof, a new flotation assembly embodying the principles and concepts of an embodiment of the disclosure and generally designated by the reference numeral 10 will be described.

As best illustrated in FIGS. 1 through 8, the modular interlocking flotation assembly 10 generally comprises a plurality of shells 12. Each shell 12 is substantially rectangularly shaped, thus defining a first end 14, a second end 16, a first side 18, and a second side 20 of the shell 12.

The first end 14 and the second end 16 may be separated by from 1.22 to 3.66 meters, while the first side 18 and the second side 20 may be separated by from 0.61 to 1.83 meters. The first end 14 and the second end 16 may be separated by from 1.83 to 3.05 meters, while the first side 18 and the second side 20 may be separated by from 0.91 to 1.52 meters. The first end 14 and the second end 16 are separated by 2.44 meters, while the first side 18 and the second side 20 are separated by 1.22 meters.

The shell 12 may comprise plastic, or other material, such as, but not limited to, fiberglass, and carbon-kevlar. The shell 12 may comprise at least one of rotomolded polyethylene, thermoformed plastic, blow molded polyethylene, and polyvinyl chloride.

Figure 2:
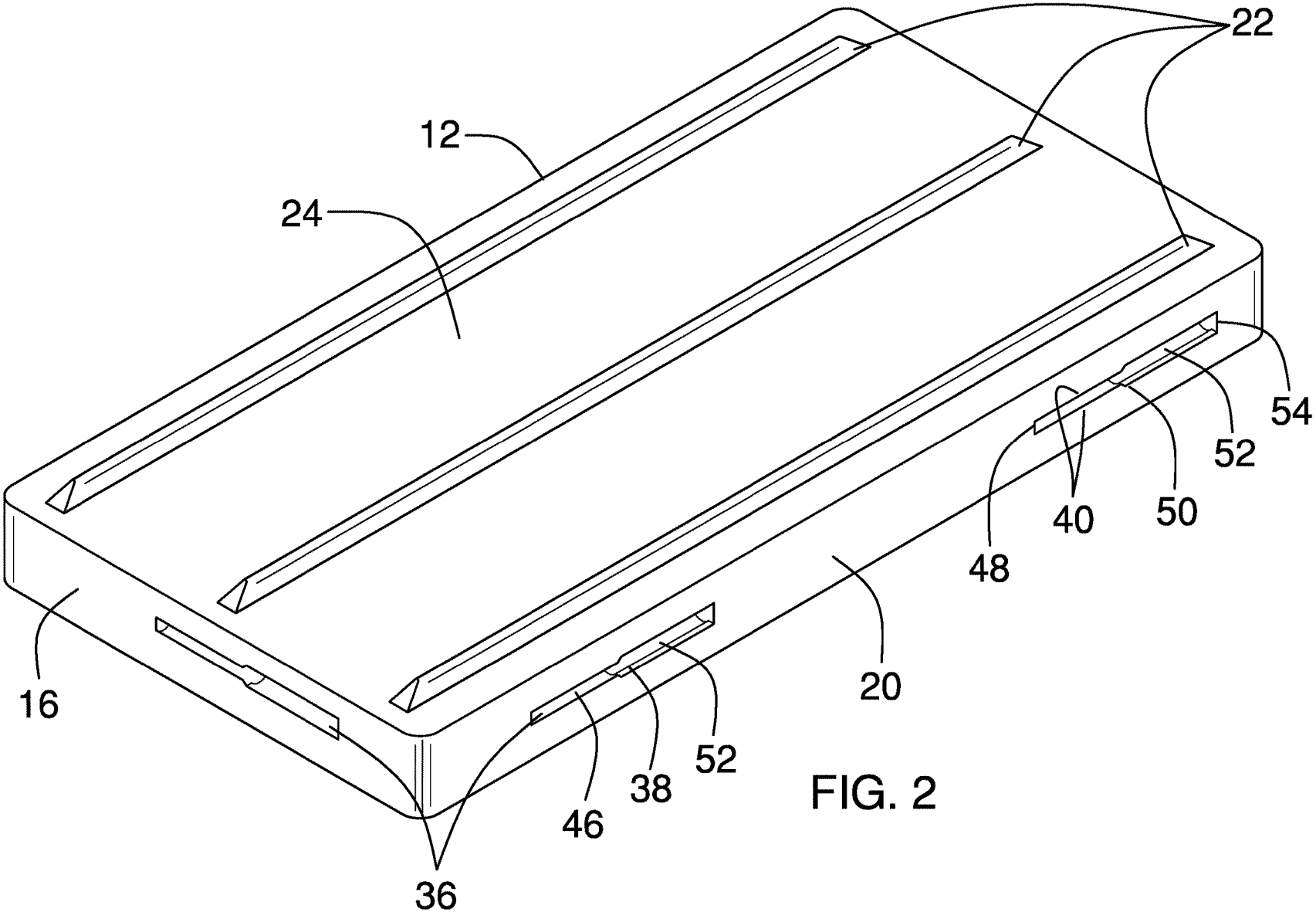
FIG. 2 is a bottom isometric perspective view of an embodiment of the disclosure.

Each of a plurality of sets of ribs 22 is coupled to a bottom 24 of a respective shell 12, as shown in FIG. 2. Each rib 22 extends from proximate to the first end 14 to proximate to the second end 16 of the respective shell 12. The ribs 22 are configured to stabilize the respective shell 12 in a water current. The set of ribs 22 comprises three ribs 22. Each rib 22 is V-shaped when viewed longitudinally. The set of ribs 22 may be integral to the respective shell 12, as may result from using rotomolding, thermoforming, and blow molding processes.

Figure 5:
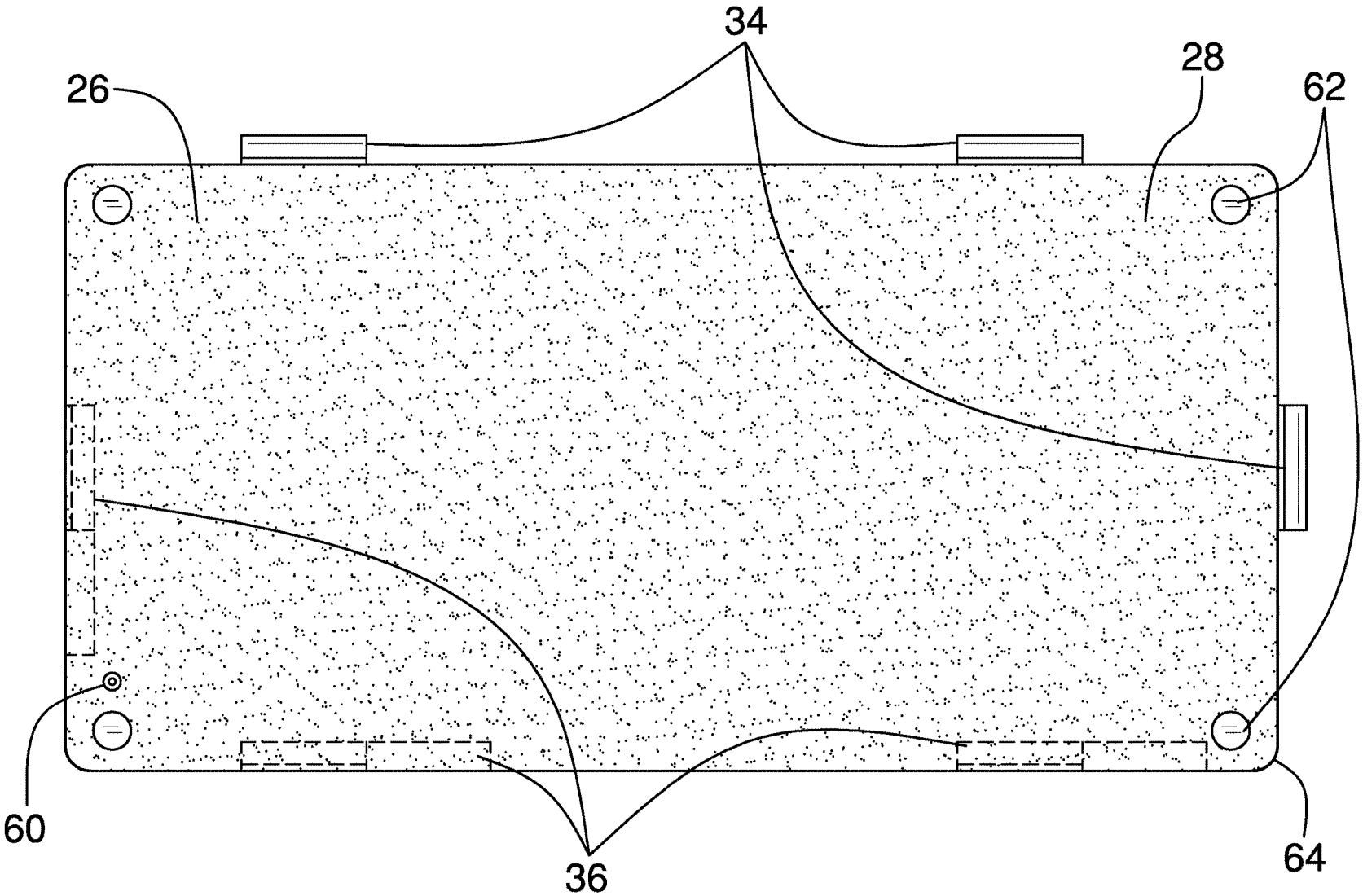
FIG. 5 is a top view of an embodiment of the disclosure.

Each of a plurality of panels 26 is coupled to a top 28 of a respective shell 12, as shown in FIG. 5. The panel 26 is textured and thus is configured to deter slippage on the top 28 of the respective shell 12. The panels 26 may comprise carpet, or the like.

Figure 7:
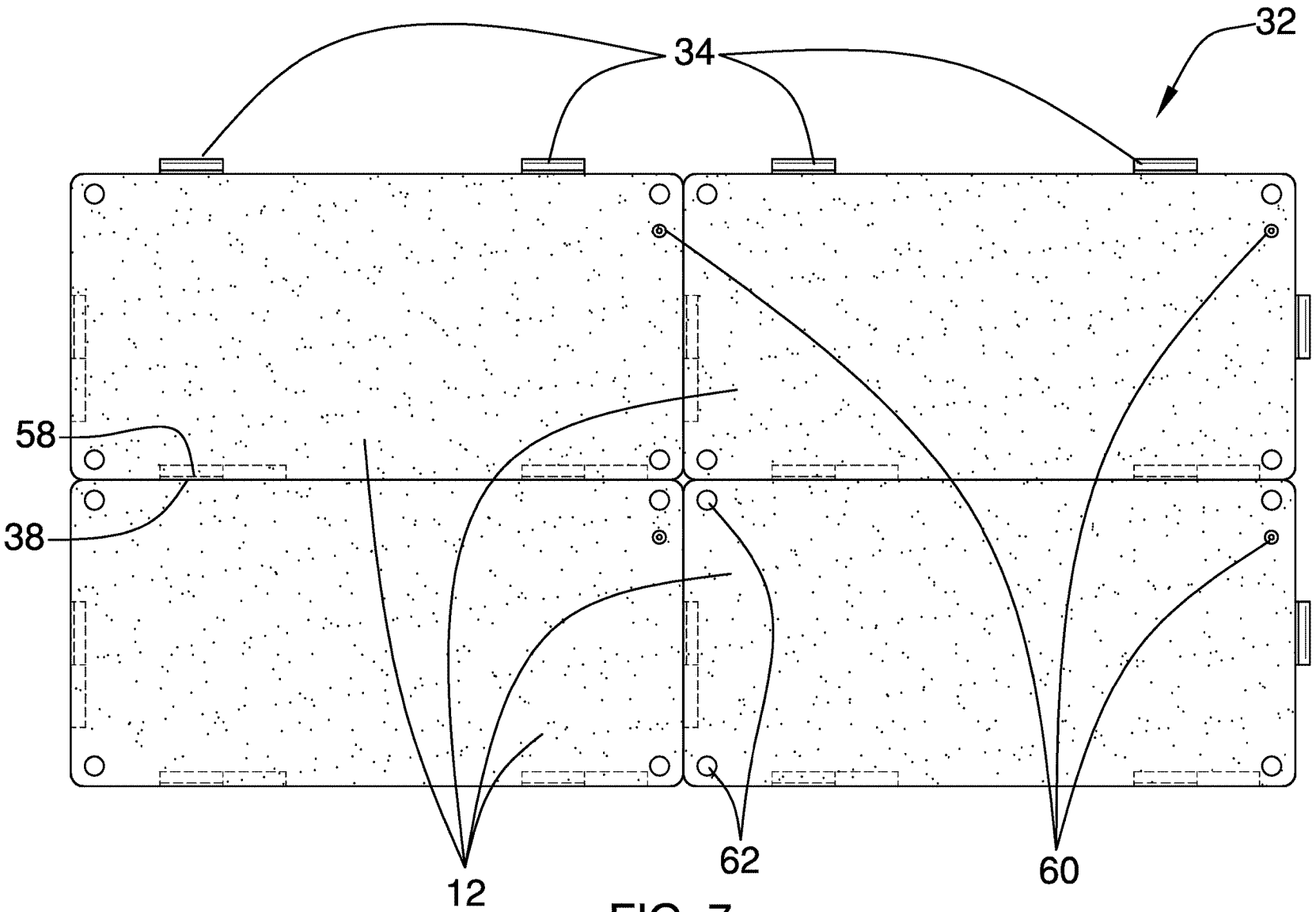
FIG. 7 is an in-use view of an embodiment of the disclosure.
Figure 8:
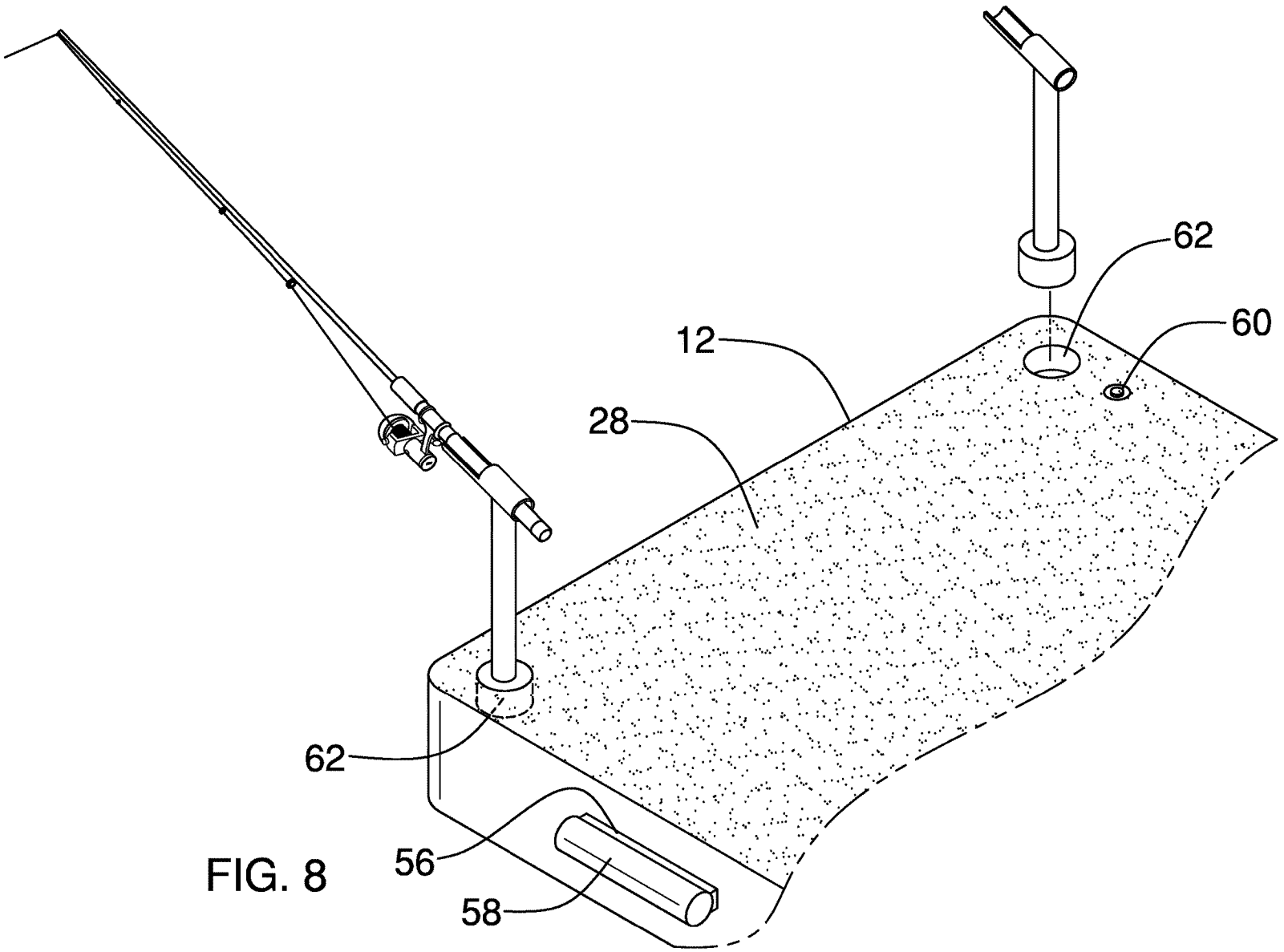
FIG. 8 is an in-use view of an embodiment of the disclosure.

Each of a plurality of couplers 30 is coupled to a respective shell 12 so that the shells 12 of the plurality of shells 12 are selectively interconnectable in a substantially planar configuration. The plurality of shells 12 thus is configured to function selectively a raft 32, as shown in FIG. 7 and a portable dock (not shown). The ability to interconnect the shells 12 allows for a variety of configurations suitable to use in various settings and situations, and by various numbers of users.

Figure 6:
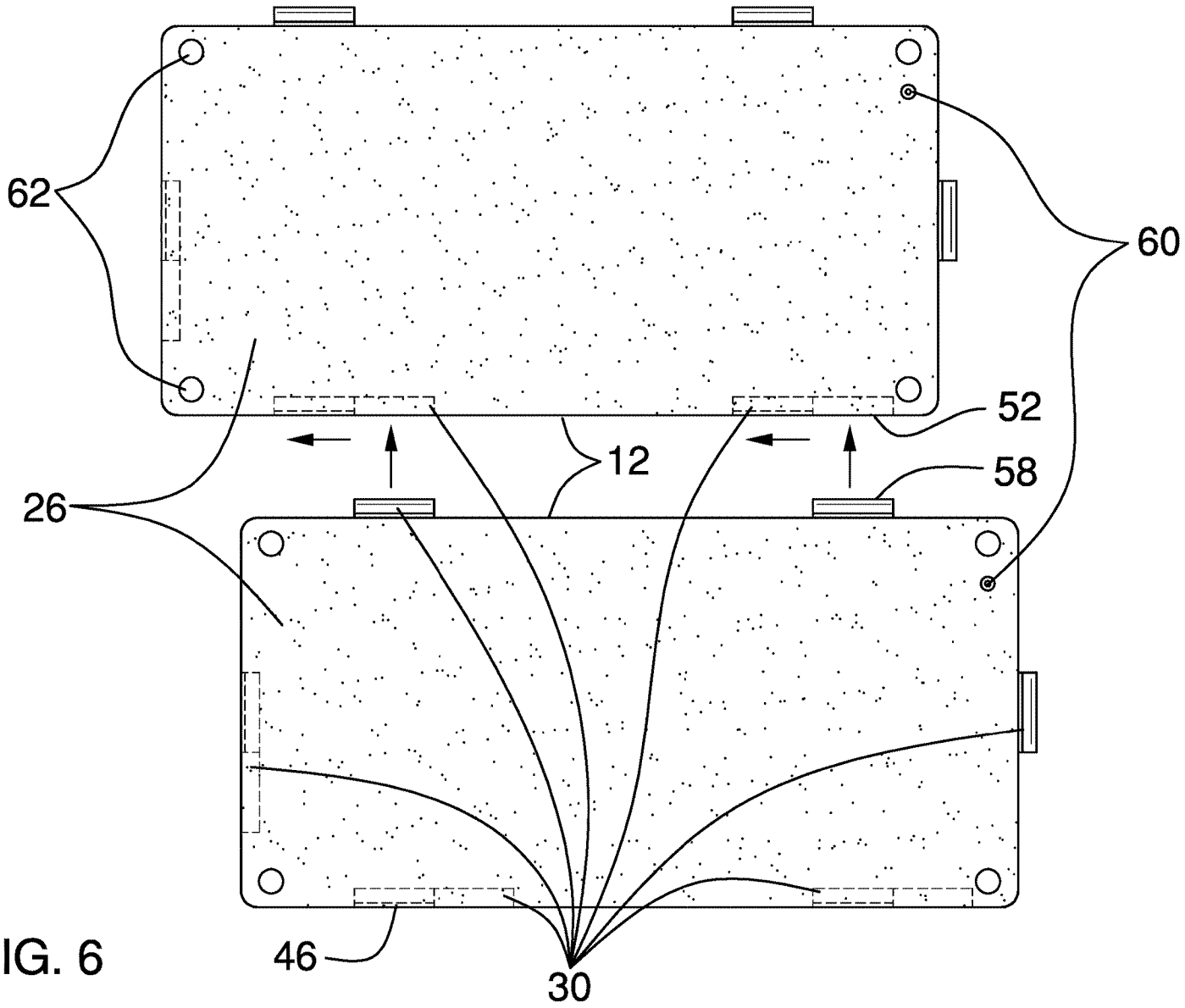
FIG. 6 is an in-use view of an embodiment of the disclosure.

The plurality of couplers 30 comprises a plurality of first connectors 34 and a plurality of second connectors 36. The first connectors 34 are coupled two-apiece to the first side 18 and singly to the first end 14 of each shell 12. The second connectors 36 are coupled two-apiece to the second side 20 and singly to the second end 16 of each shell 12. The second connectors 36 are complementary to the first connectors 34. The second connectors 36 that are positioned on the second side 20 of one of the shells 12 are positioned to selectively couple singly to respective first connectors 34 that are positioned on the first side 18 of another of the shells 12 to interconnect the shells 12 in a side to side configuration, as shown in FIG. 6. The second connector 36 that is positioned on the second end 16 of one of the shells 12 is positioned to selectively couple to a respective first connector 34 that is positioned on the first end 14 of another of the shells 12 to interconnect the shells 12 in a head to tail configuration, as is shown with the top 28 two shell 12 in FIG. 7.

Figure 3:
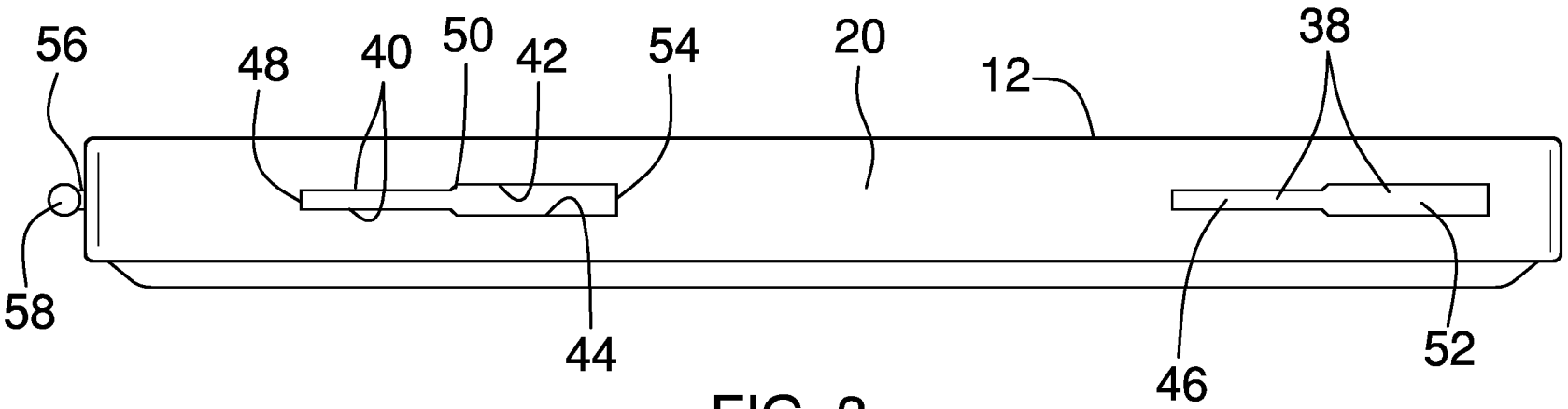
FIG. 3 is a side view of an embodiment of the disclosure.
Figure 4:
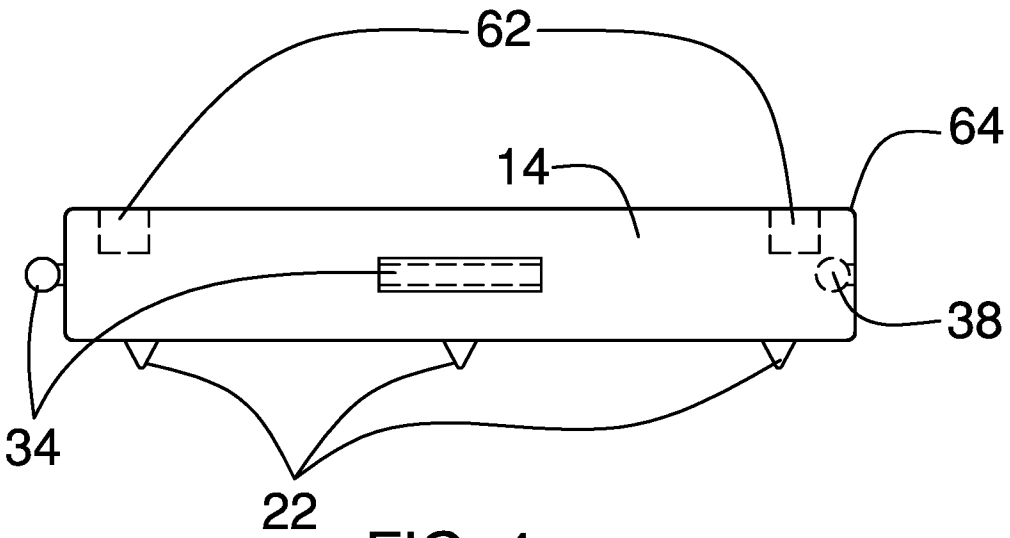
FIG. 4 is an end view of an embodiment of the disclosure.

Each second connector 36 comprises a void 38 and a pair of slats 40, as shown in FIG. 3. The void 38 extends into a respective shell 12 so that the void 38 is parallel to the top 28 of the respective shell 12. The slats 40 are coupled singly to an upper edge 42 and a lower edge 44 of the void 38 and extend toward the lower edge 44 and the upper edge 42, respectively, to define a slot 46. The slats 40 extend from a first terminus 48 of the void 38 to proximate to a midpoint 50 of the void 38 to define an opening 52 that extends from the midpoint 50 to a second terminus 54 of the void 38.

Each first connector 34 comprises a plate 56 and a rod 58. The plate 56 is coupled to and extends perpendicularly from a respective shell 12. The rod 58 is coupled longitudinally to the plate 56 distal from the respective shell 12. The rod 58 is positioned to be inserted into a respective opening 52, positioning the plate 56 to slide into the slot 46 to interconnect a pair of shells 12.

Each of a plurality of plugs 60 is positioned in a respective shell 12. The plug 60 is configured to be removed to to drain the respective shell 12.

Each of a plurality of recesses 62 extends into the top 28 of a respective shell 12, as shown in FIG. 5. The recess 62 is configured to stow an article of a user. The plurality of recesses 62 comprises recesses 62 that are positioned singly proximate to each corner 64 of each shell 12. The respective recess 62 also is complementary to a base of a rod holder. The respective recess 62 thus is configured to allow insertion of the base of the rod holder to couple the rod holder to the associated shell 12. The rod holders facilitate fishing from the associated shell 12, the raft 32, or the portable dock.

In use, a number of the shells 12 suited for use in a desired situation are interconnected. To interconnect shells 12 in the side to side configuration, the two rods 58 that are positioned on the first side 18 of one shell 12 are inserted singly into the two openings 52 that are positioned on the second side 20 of another shell 12. The shells 12 are then slid relative to each other so that the plates 56 slide into the slots 46 to interconnect the shells 12. To interconnect shells 12 in the head to tail configuration, the rod 58 that is positioned on the first end 14 of one shell 12 is inserted into the opening 52 that is positioned on the second end 16 of another shell 12. The shells 12 are then slid relative to each other so that the plate 56 slides into the slot 46 to interconnect the shells 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A modular interlocking flotation assembly comprising:

a plurality of shells, each shell being substantially rectangularly shaped defining a first end, a second end, a first side, and a second side of the shell;

a plurality of couplers, each coupler being coupled to a respective shell such that the shells of the plurality of shells are selectively interconnectable in a substantially planar configuration wherein the plurality of shells is configured for functioning selectively as a raft and a portable dock, the plurality of couplers comprising a plurality of first connectors, the first connectors being coupled two-apiece to the first side and singly to the first end of each shell, each first connector comprising a plate and rod, and a plurality of second connectors, the second connectors being coupled two-apiece to the second side and singly to the second end of each shell, the second connectors being complementary to the first connectors wherein the second connectors positioned on the second side of one of the shells are positioned for selectively coupling singly to respective first connectors positioned on the first side of another of the shells for interconnecting the shells in a side to side configuration and wherein the second connector positioned on the second end of one of the shells is positioned for selectively coupling to a respective first connector positioned on the first end of another of the shells for interconnecting the shells in a head to tail configuration, each second connector being a void receiving the respective first connector; and a plurality of plugs, each plug being positioned in a respective shell wherein the plug is configured for being selectively removed for draining the respective shell.

2. The assembly of claim 1, further including the first end and the second end being separated by from 1.22 to 3.66 meters, the first side and the second side being separated by from 0.61 to 1.83 meters.

3. The assembly of claim 2, further including the first end and the second end being separated by from 1.83 to 3.05 meters, the first side and the second side being separated by from 0.91 to 1.52 meters.

4. The assembly of claim 3, further including the first end and the second end being separated by 2.44 meters, the first side and the second side being separated by 1.22 meters.

5. The assembly of claim 1, further including the shell comprising plastic.

6. The assembly of claim 5, further including the shell comprising at least one of rotomolded polyethylene, thermoformed plastic, blow molded polyethylene, and polyvinyl chloride.

7. The assembly of claim 1, further including a plurality of panels, each panel being coupled to a top of a respective shell, the panel being textured wherein the panel is configured for deterring slippage on the top of the respective shell.

8. A modular interlocking flotation assembly comprising:

a plurality of shells, each shell being substantially rectangularly shaped defining a first end, a second end, a first side, and a second side of the shell;

a plurality of couplers, each coupler being coupled to a respective shell such that the shells of the plurality of shells are selectively interconnectable in a substantially planar configuration wherein the plurality of shells is configured for functioning selectively as a raft and a portable dock; and a plurality of sets of ribs, each set of ribs being coupled to a bottom of a respective shell, each rib extending from proximate to the first end to proximate to the second end of the respective shell wherein the ribs are configured for stabilizing the respective shell in a water current.

9. The assembly of claim 8, further including the set of ribs comprising three ribs.

10. The assembly of claim 8, further including each rib being shaped when viewed longitudinally.

11. The assembly of claim 8, further including the set of ribs being integral to the respective shell.

12. A modular interlocking flotation assembly comprising:

a plurality of shells, each shell being substantially rectangularly shaped defining a first end, a second end, a first side, and a second side of the shell; and a plurality of couplers, each coupler being coupled to a respective shell such that the shells of the plurality of shells are selectively interconnectable in a substantially planar configuration wherein the plurality of shells is configured for functioning selectively as a raft and a portable dock, the plurality of couplers comprising a plurality of first connectors, the first connectors being coupled two-apiece to the first side and singly to the first end of each shell; and a plurality of second connectors, the second connectors being coupled two-apiece to the second side and singly to the second end of each shell, the second connectors being complementary to the first connectors wherein the second connectors positioned on the second side of one of the shells are positioned for selectively coupling singly to respective first connectors positioned on the first side of another of the shells for interconnecting the shells in a side to side configuration and wherein the second connector positioned on the second end of one of the shells is positioned for selectively, coupling to a respective first connector positioned on the first end of another of the shells for interconnecting the shells in a head to tail configuration, each second connector comprising a void and a pair of slats, the void extending into a respective shell such that the void is parallel to a top of the respective shell, the slats being coupled singly to an upper edge and a lower edge of the void and extending toward the lower edge and the upper edge, respectively, defining a slot, the slats extending from a respective terminus of the void to proximate to a midpoint of the void defining an opening extending from the midpoint to a second terminus of the void, each first connector comprising a plate and a rod, the plate being coupled to and extending perpendicularly from a respective shell, the rod being coupled longitudinally to the plate distal from the respective shell such that the rod is positioned for inserting into a respective opening positioning the plate for sliding into the slot for interconnecting a pair of shells.

13. A modular interlocking flotation assembly comprising:

a plurality of shells, each shell being substantially rectangularly shaped defining a first end, a second end, a first side, and a second side of the shell;

a plurality of couplers, each coupler being coupled to a respective shell such that the shells of the plurality of shells are selectively interconnectable in a substantially planar configuration wherein the plurality of shells is configured for functioning selectively as a raft and a portable dock; and a plurality of recesses, each recess extending into a top of a respective shell wherein the recess is configured for stowing an article of a user.

14. The assembly of claim 13, further including the plurality of recesses comprising recesses positioned singly proximate to each corner of each shell.

15. The assembly of claim 13, further including the respective recess being complementary to a base of a rod holder wherein the respective recess is configured for inserting the base of the rod holder for coupling the rod holder to the associated shell.

16. A modular interlocking flotation assembly comprising:

a plurality of shells, the shells being selectively inflatable, each shell being substantially rectangularly shaped defining a first end, a second end, a first side, and a second side of the shell, the first end and the second end being separated by from 1.22 to 3.66 meters, the first side and the second side being separated by from 0.61 to 1.83 meters, the first end and the second end being separated by from 1.83 to 3.05 meters, the first side and the second side being separated by from 0.91 to 1.52 meters, the first end and the second end being separated by 2.44 meters, the first side and the second side being separated by 1.22 meters, the shell comprising plastic, the shell comprising at least one of rotomolded polyethylene; thermoformed plastic, blow molded polyethylene, and polyvinyl chloride;

a plurality of sets of ribs, each set of ribs being coupled to a bottom of a respective shell, each rib extending from proximate to the first end to proximate to the second end of the respective shell wherein the ribs are configured for stabilizing the respective shell in a water current, the set of ribs comprising three ribs, each rib being V-shaped when viewed longitudinally, the set of ribs being integral to the respective shell;

a plurality of panels, each panel being coupled to a top of a respective shell, the panel being textured wherein the panel is configured for deterring slippage on the top of the respective shell, the panels comprising carpeting;

a plurality of couplers, each coupler being coupled to a respective shell such that the shells of the plurality of shells are selectively interconnectable in a substantially planar configuration wherein the plurality of shells is configured for functioning selectively as a raft and a portable dock, the plurality of couplers comprising:

a plurality of first connectors, the first connectors being coupled two-apiece to the first side and singly to the first end of each shell, a plurality of second connectors, the second connectors being coupled two-apiece to the second side and singly to the second end of each shell, the second connectors being complementary to the first connectors wherein the second connectors positioned on the second side of one of the shells are positioned for selectively coupling singly to respective first connectors positioned on the first side of another of the shells for interconnecting the shells in a side to side configuration and wherein the second connector positioned on the second end of one of the shells is positioned for selectively coupling to a respective first connector positioned on the first end of another of the shells for interconnecting the shells in a head to tail configuration, each second connector comprising a void and a pair of slats, the void extending into a respective shell such that the void is parallel to the top of the respective shell, the slats being coupled singly to an upper edge and a lower edge of the void and extending toward the lower edge and the upper edge, respectively, defining a slot, the slats extending from a respective terminus of the void to proximate to a midpoint of the void defining an opening extending from the midpoint to a second terminus of the void, each first connector comprising a plate and a rod, the plate being coupled to and extending perpendicularly from a respective shell, the rod being coupled longitudinally to the plate distal from the respective shell such that the rod is positioned for inserting into a respective opening positioning the plate for sliding into the slot for interconnecting a pair of shells;

a plurality of plugs, each plug being positioned in a respective shell wherein the plug is configured for being selectively removed for draining the respective shell; and a plurality of recesses, each recess extending into the top of a respective shell wherein the recess is configured for stowing an article of a user, the plurality of recesses comprising recesses positioned singly proximate to each corner of each shell, the respective recess being complementary to a base of a rod holder wherein the respective recess is configured for inserting the base of the rod holder for coupling the rod holder to the associated shell.

* * * * *